US008241433B2

(12) United States Patent
Hellweg

(10) Patent No.: US 8,241,433 B2
(45) Date of Patent: Aug. 14, 2012

(54) METHOD FOR METERING A FIRST AND A SECOND TREATMENT AGENT TO A RINSE CONTAINER OF A DISH WASHER

(75) Inventor: Markus Hellweg, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 455 days.

(21) Appl. No.: 12/497,795

(22) Filed: Jul. 6, 2009

(65) Prior Publication Data

US 2010/0006593 A1 Jan. 14, 2010

(30) Foreign Application Priority Data

Jul. 10, 2008 (DE) ..... 10 2008 032 363

(51) Int. Cl.
*B08B 9/20* (2006.01)

(52) U.S. Cl. ..... 134/25.2; 134/18; 134/26; 134/29; 222/1; 222/64

(58) Field of Classification Search ..... None
See application file for complete search history.

(56) References Cited

U.S. PATENT DOCUMENTS

| | | | |
|---|---|---|---|
| 2007/0144558 | A1 | 6/2007 | Classen et al. |
| 2009/0000644 | A1 | 1/2009 | Druecker et al. |
| 2010/0000580 | A1 | 1/2010 | Classen et al. |

FOREIGN PATENT DOCUMENTS

| | | | |
|---|---|---|---|
| DE | 10358969 | A1 | 7/2005 |
| DE | 102006043915 | A1 | 3/2008 |
| EP | 0392196 | | 10/1990 |
| EP | 1329187 | | 7/2003 |

OTHER PUBLICATIONS

DE 3911862 trans retrieved Dec. 17, 2011 from http://translationportal.epo.org/emtp/translate/?ACTION=description-retrieval&COUNTRY=DE&FORMAT=docdb&KIND=A1&LOCALE=en_EP&NUMBER=3911862&OPS=ops.epo.org&TRGLANG=en&ENGINE=google&SRCLANG=de and http://translationportal.epo.org/emtp/translate/?ACTION=claims-retrieval&COUNTRY=DE&FORMAT=docdb&KIND=A1&LOCALE.*

DE 102005059343 trans retrieved Dec. 17, 2011 from http://translationportal.epo.org/emtp/t/ranslate/?ACTION=description-retrieval&COUNTRY=DE&FORMAT=docdb&KIND=A1&LOCALE=en_EP&NUMBER=102005059343&OPS=ops.epo.org&TRGLANG=en&ENGINE=google&SRCLANG=de and http://translationportal.epo.org/emtp/translate/?ACTION=claims-retrieval&COUNTRY=DE&FORMAT=docdb&KIN.*

* cited by examiner

*Primary Examiner* — Michael Kornakov
*Assistant Examiner* — Eric Golightly
(74) *Attorney, Agent, or Firm* — Leydig, Voit & Mayer, Ltd.

(57) ABSTRACT

A method for dispensing a first treating agent and a second treating agent into the washing tub of a dishwasher includes providing each of first and second reservoirs with a sensor for monitoring its fill level. After a first dispensing operation, a controller compares the sensor signals and determines whether a ratio of the fill levels deviates from a ratio of the capacities of the reservoirs. The controller elects either a standard or an alternative subsequent dispensing operation based on whether the fill level ratio deviates from the capacity ratio. The controller chooses the standard subsequent dispensing operation if the fill level ratio does not deviate from the capacity ratio and chooses the alternative subsequent dispensing operation if it does. The alternative subsequent dispensing operation includes changing at least one amount dispensed by dispensing devices compared to a corresponding amount dispensed in the first dispensing operation.

11 Claims, 3 Drawing Sheets

METHOD FOR METERING A FIRST AND A SECOND TREATMENT AGENT TO A RINSE CONTAINER OF A DISH WASHER

CROSS REFERENCE TO RELATED APPLICATIONS

Priority is claimed to German Patent Application No. DE 10 2008 032 363.2, filed Jul. 10, 2008, the entire disclosure of which is incorporated by reference herein.

FIELD

The present invention relates to a method for dispensing a first treating agent and a second treating agent into the washing tub of a dishwasher including a first reservoir and a first dispensing device corresponding to the first treating agent, and a second reservoir and a second dispensing device corresponding to the second treating agent.

German Patent Application DE 10 2005 059 343 A1 describes a method for dispensing cleaning agent and bleaching agent into the washing tub of a dishwasher, in which method two separate reservoirs of different capacities are provided, and in which the cleaning agent and the bleaching agent are dispensed during a wash cycle in quantities whose ratio is equal to the ratio of the capacities of the reservoirs. Since two different treating agents are used during a wash cycle, it is desirable to be able to refill the two agents at the same time in one operation. To this end, the empty volume available in each reservoir must be sufficient to receive a predetermined refill quantity which is generally equal to or greater than the capacity of a supply container of such an agent. The volume to be used for one cycle can be controlled in different ways, such as by the ON time of a dispensing pump, the opening time of an outlet valve, or the size of a dispensing chamber. German Patent Application DE 10 2005 059 343 A1 uses a dispensing system having a dispensing chamber that can be closed off from both the reservoir and an outlet port. This makes it possible to fill the dispensing chamber, or to discharge a fluid contained in the dispensing chamber, as needed. All of the conceivable methods for controlling an amount to be dispensed are encumbered with tolerances. Such tolerances may cause the dispensing chambers to empty at different rates in an unwanted manner. Also, failure to completely empty a supply container, or failure to completely fill a reservoir for other reasons may cause the respective reservoir to empty before the other.

EP 1 329 187 A2 describes a combination dispenser for receiving detergent for one wash cycle and rinse aid for multiple wash cycles.

SUMMARY

An aspect of the present invention is to provide a method for dispensing a first treating agent and a second treating agent into the washing tub of a dishwasher, which method allows at least two reservoirs to empty at substantially the same time, even if tolerance-related deviations occur during the dispensing process.

In an embodiment, the present invention provides a method for dispensing a first treating agent and a second treating agent into the washing tub of a dishwasher. The dishwasher includes a first reservoir and a first dispensing device corresponding to the first treating agent and a second reservoir and a second dispensing device corresponding to the second treating agent. The method includes providing each of the first and second reservoir with at least one sensor for monitoring a fill level of the respective reservoir. After a first dispensing operation, the first and second sensor signals corresponding to the at least one sensor of the respective first and second reservoirs are compared using a controller. Based on the first and second sensor signals, the controller is used to determine whether a first ratio of a fill level of the first reservoir to a fill level of the second reservoir deviates from a second ratio of a capacity of the first reservoir to a capacity of the second reservoir. Based on the determining, one of a standard and alternative subsequent dispensing operation is elected. The standard subsequent dispensing operation is elected if the first ratio does not deviate from the second ratio and the alternative subsequent dispensing operation is elected if the first ratio does deviate from the second ratio. The standard subsequent dispensing operation includes controlling, with the controller, the first and second dispensing devices so as to dispense a first amount from the first dispensing device and a second amount from the second dispensing device, the first and second amounts so as to dispense a first amount of the first dispensing device and a second amount from the second dispensing device. A ratio of the first amount to the second amount is substantially equal to the ratio of the capacities of the first and second reservoirs. The alternative subsequent dispensing operation includes changing at least one amount dispensed by the first and second dispensing devices compared to a respective corresponding amount dispensed in the first dispensing operation.

BRIEF DESCRIPTION OF THE DRAWINGS

The present invention will be explained in more detail below with reference to an exemplary embodiment and the accompanying drawings, in which.

DETAILED DESCRIPTION

Figure 1:
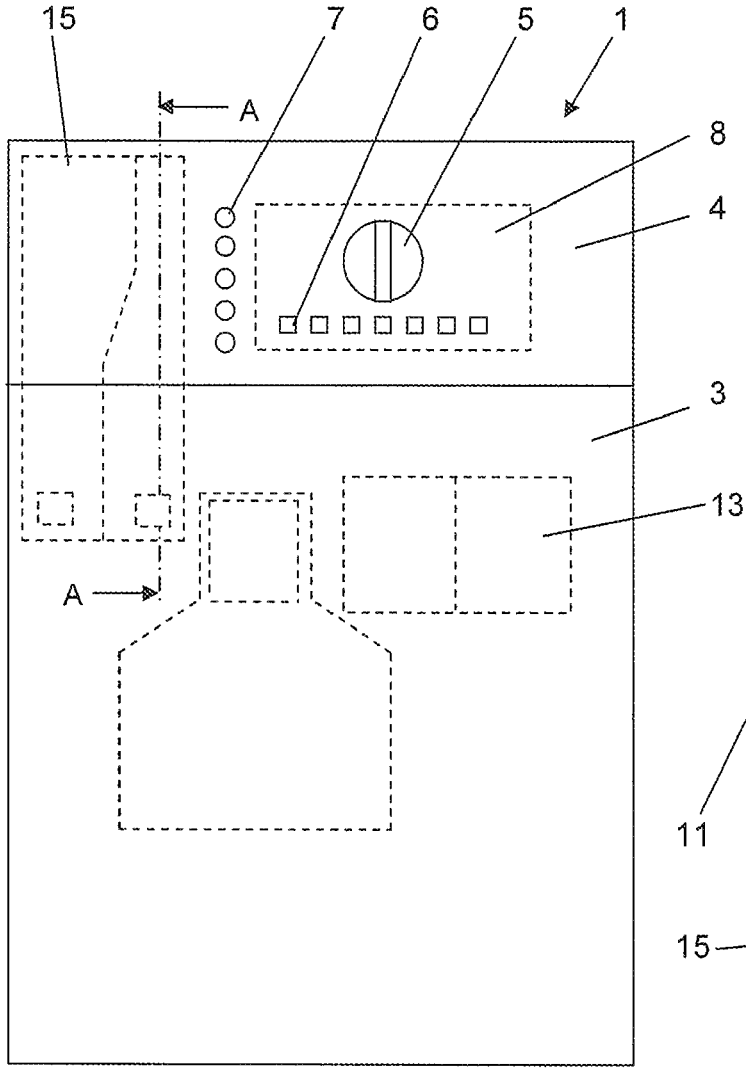
FIG. 1 is a schematic view of the front side of a household dishwasher configured in accordance with an embodiment the present invention.

The monitoring of the fill level in each reservoir by at least one sensor enables a controller to determine, after a dispensing operation, from the sensor signals whether the ratio of the fill level of the first reservoir to that of the second reservoir deviates from the ratio of the capacity of the first reservoir to that of the second reservoir. This allows the dispensed amounts to be controlled by the controller in such a manner that the amounts intended to be dispensed are maintained in a subsequent dispensing operation if the ratio of the fill level of the first reservoir to that of the second reservoir does not deviate from the ratio of the capacity of the first reservoir to that of the second reservoir. However, if it is established that the ratio of the fill level of the first reservoir to that of the second reservoir deviates from the ratio of the capacity of the first reservoir to that of the second reservoir, then the amounts intended to be dispensed can be changed by the controller for the subsequent dispensing operation, it being alternatively possible to change only one amount to be dispensed or both amounts to be dispensed. Thus, the amounts to be dispensed can be adjusted in a manner that allows the first and second reservoirs to empty at substantially the same time, even if emptying has occurred unevenly because of tolerances in the dispensing of the treating agents, as a result of which an amount different from a predetermined target amount has been dispensed. Accordingly, the controller exerts a compensating effect to achieve simultaneous emptying and thereby allow the user to refill both treating agents in one operation.

In one embodiment, each reservoir is provided with only one sensor, and each sensor monitors a discrete fill level with a predetermined residual volume. In order to have sufficient capacity to compensate for the dispensing error, the residual volume is about 20% of the capacity of the respective reservoir. This also ensures that the dispensing of the treating agents is not corrected until the reservoir can actually be expected to empty soon. This makes it possible to dispense the targeted amount of the respective detergent for more than half the volume of the reservoir.

When the monitored fill level is reached, the amount to be dispensed may be reduced, for example, by 10% to 50% compared to the previously dispensed amount, thereby adjusting the instantaneous amount. Alternatively, or additionally, it is possible to increase the amount to be dispensed from the other reservoir by 10% to 50% compared to the previously dispensed amount once the monitored fill level is reached. This allows the instantaneous amounts to be adjusted in a particularly effective manner, especially when a deviation is detected between the empty volumes of the two reservoirs.

According to another embodiment, the controller counts the dispensing operations for which the amounts intended to be dispensed are changed until the fill levels monitored by the sensors are reached in both reservoirs. Using this information, the controller can determine with at least approximate accuracy the magnitude of the error that occurred during the dispensing process and, once the fill levels monitored by the sensors are both reached, the controller, based on the number of dispensing operations detected by the controller to have been performed with a changed amount, can then cause an additional number of dispensing operations to be performed also with a changed amount. Using suitable statistical methods, it can then be ensured that both reservoirs empty at approximately the same time.

In one embodiment, when or shortly before the reservoirs have reached an empty level, an alert is issued, prompting the user to refill the two reservoirs. This increases the ease-of-use, because the user must perform the refilling of the reservoirs only once, thereby avoiding separate filling.

Figure 2:
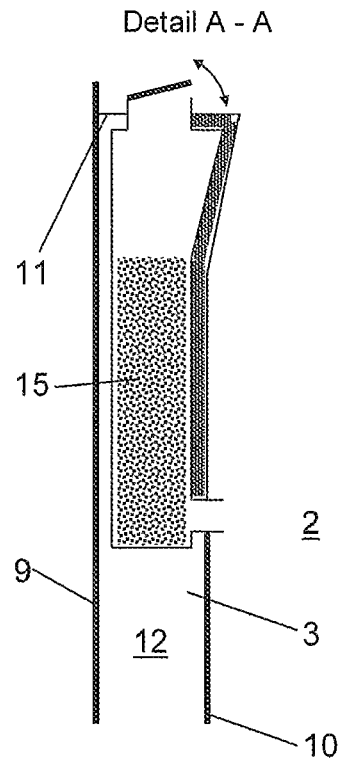
FIG. 2 is a cross-sectional view through the upper portion of the appliance door of the household dishwasher shown in FIG. 1.

FIG. 1 shows the front side of a household dishwasher 1, which is known to include a washing tub 2 which is open at the front and can therefore be closed by a hinged appliance door 3. This figure shows the appliance with the door 3 closed. Therefore, washing tub 2, which is fragmentarily shown in FIG. 2, cannot be seen in FIG. 1. The upper portion of door 3 may accommodate a control panel 4 containing a rotary selector switch 5 and/or push buttons 6 for cycle selection and further containing indicators 7 used to display information to the user. A controller 8 and further electrical and electronic components are disposed inside the control panel, which is symbolized by the dashed-line box. As can be seen in FIG. 2, door 3 is formed of an outer door panel 9 and an inner door panel 10. Inner door panel 10 has a folded edge 11, so that a closed hollow body 12 is formed when outer door panel 9 and inner door panel 10 are assembled together. The dispensing systems and reservoirs, which will be described hereinafter, are disposed within this hollow body 12, and are therefore indicated as dashed-line shapes. The valves, hose connections, and electrical wires, etc., which are also needed, are not the subject matter of the present invention and are therefore not shown here. The middle portion of the door accommodates a so-called combination dispenser 13, said combination dispenser being capable of receiving powdered detergent or detergent tabs for one wash cycle and of receiving rinse aid for several wash cycles. There may also be provided a salt container 14 to receive the water softener salt necessary to regenerate a water softener. In accordance with the present invention, a further dispensing system 15 is disposed in the upper left half of appliance door 3.

Figure 3:
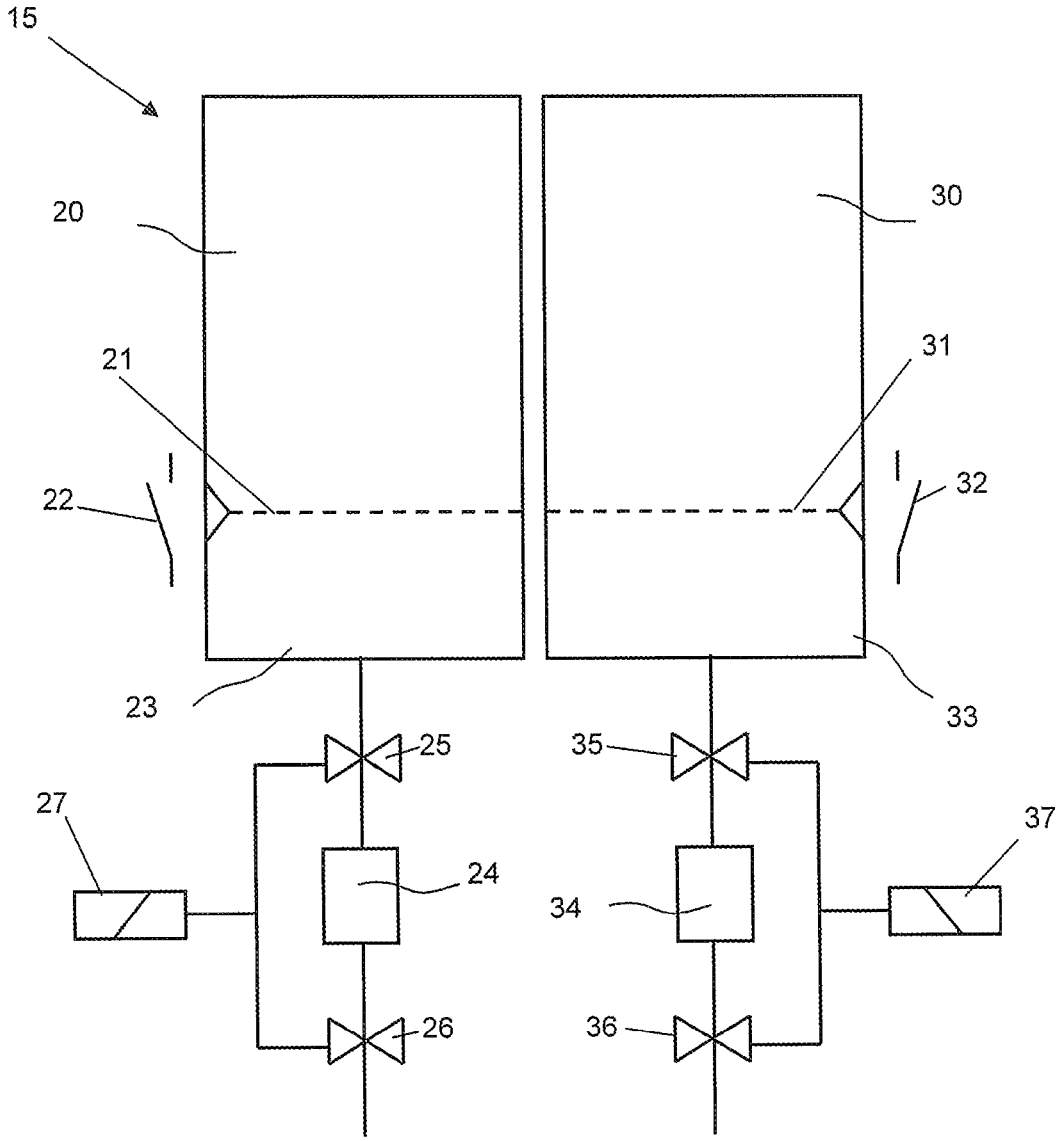
FIG. 3 is a schematic view of a system for dispensing two treating agents.

Further dispensing system 15 is capable of discharging liquid or pasty cleaning agent and liquid or pasty bleaching agent in a program-controlled manner. FIG. 3 shows said further dispensing system purely schematically. The active components are stored separately in two different reservoirs, namely reservoirs 20 and 30. Thus, the enzymatic/alkaline and bleaching components, which are incompatible in liquid and/or pasty formulations, are not mixed until they are in the washing tub, where they can then produce their full effect.

First reservoir 20 has connected thereto a dispensing device including a dispensing chamber 24, a valve 25 being disposed between reservoir 20 and dispensing chamber 24, and a valve 26 allowing dispensing chamber 24 to be closed off on the side that faces an outlet port. Valves 25 and 26 are controllable by an actuating element 27. Similarly, the outlet side of reservoir 30 is connected via a valve 35 to a dispensing chamber 34. When a valve 36 is open, dispensing chamber 34 can discharge the second treating agent through an outlet port. Valves 35 and 36 are controlled by a second actuating element 37.

It is also possible to provide dispensing devices which use a dispensing pump, in which an outlet valve is opened for a predetermined period of time, or in which other fluid-delivery devices are provided.

In order to dispense a first and second treating agent, initially, valves 25 and 35 are opened, allowing the respective treating agent to flow into dispensing chamber 24 or 34, respectively. The metered dose corresponds to the size of dispensing chambers 24 or 34, respectively. When the two dispensing chambers 24 and 34 are full, valves 25 and 35 are closed, and valves 26 and 36 at the outlet port are opened to start the dispensing operation. In this manner, the two treating agents are added into the washing tub of a dishwasher. After that, valves 26 and 36 are closed. This dispensing cycle is repeated until a predetermined amount has been dispensed. The capacities of reservoirs 20 and 30 are matched to the amounts to be dispensed, so that, for example, an amount of a first treating agent can be added twenty times, and a correspondingly larger or smaller amount of the second treating agent in reservoir 30 can also be added twenty times as a target amount. This is possible because the amounts are proportional to the capacities of the respective reservoirs, so that when accurate amounts are dispensed, reservoirs 20 and 30 will empty at the same time.

In order to check whether the desired amounts of the first and second treating agents were actually dispensed, or whether there are noticeable deviations, reservoir 20 is equipped with a first sensor 22 capable of indicating a predetermined fill level 21 which indicates that no more than a predetermined residual volume 23 remains in reservoir 20. Similarly, the reservoir 30 is provided with a sensor 32 which is capable of detecting a fill level 31. Sensor 32 makes it possible to detect a residual volume 33. Residual volumes 23 and 33 are selected to be proportional to the volumes of reservoirs 20 and 30; i.e., the ratio of the two residual volumes 23 and 33 is equal to the ratio of the capacities of the two reservoirs 20 and 30.

Sensors 22 and 32 can take the form of threshold switches which output signals to controller 8 when the respective fill levels 21 and 31 are reached.

If, for example because of tolerances or unequal filling, reservoirs 20 and 30 do not empty evenly, controller 8 can adjust the amounts to be dispensed, since it is beneficial for the user if the two reservoirs 20 and 30 reach a reserve volume, or empty, at the same time, because then both reservoirs 20 and 30 can be filled at the same time. When doing this, it should be possible to pour an entire refill container into the reservoir. Therefore, it is advantageous for the user not to be prompted to refill the reservoirs until both reservoirs have emptied sufficiently.

Figure 4:
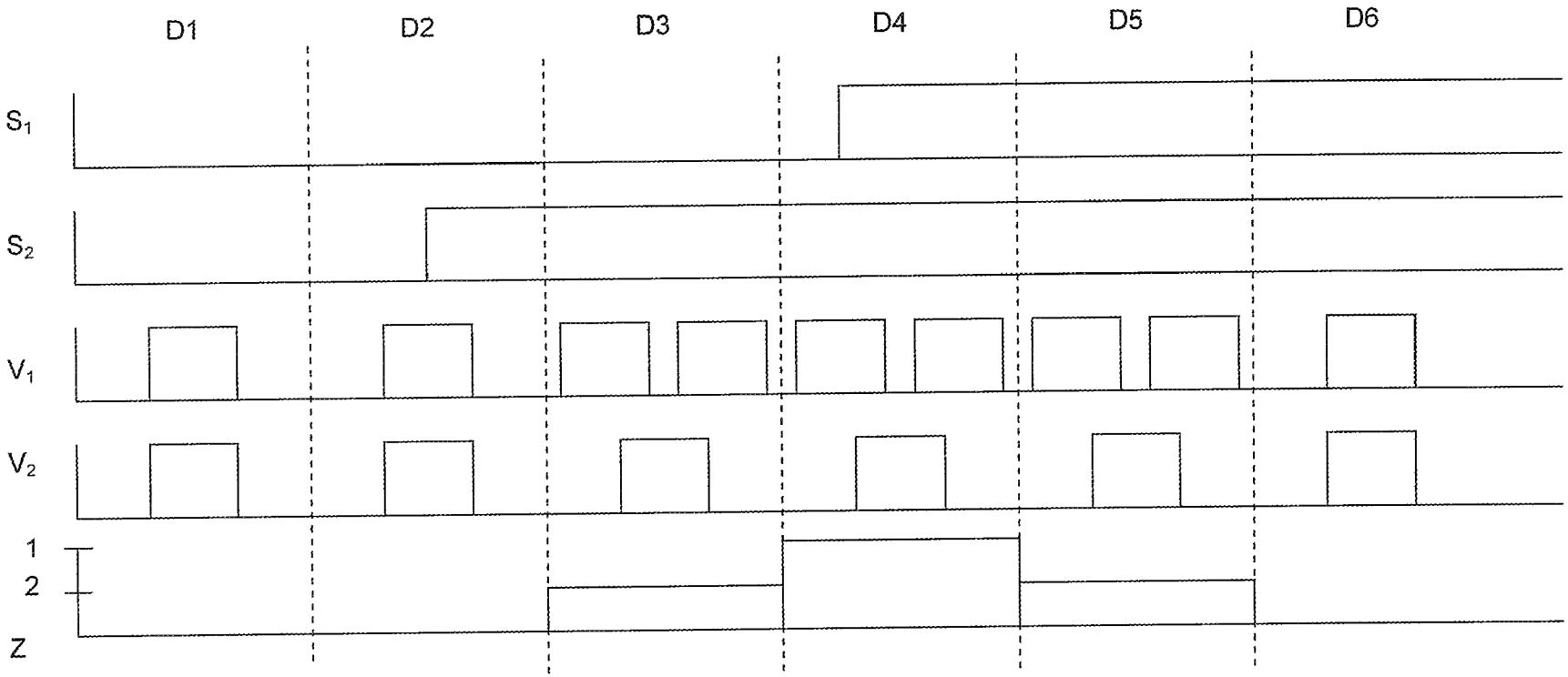
FIG. 4 is a timing diagram of various sensor signals and state variables during the execution of the method according to the present invention.

FIG. 4 schematically shows a timing diagram of various sensor signals and state variables during the execution of the method according to the present invention. It is assumed here that reservoirs 20 and 30 have identical capacities and that, accordingly, the dispensed amounts $V_1$ (dispensing chamber 24) and $V_2$ (dispensing chamber 34) are initially equal. If different amounts $V_1$ and $V_2$ are to be dispensed, the reservoirs should be sized accordingly. The diagram shows a total of six dispensing operations, here referred to as dispensing cycles D1 through D6. These dispensing cycles may occur in six successive wash cycles, but it is also possible for several dispensing cycles to take place in the course of one wash cycle. Initially, in a first dispensing cycle D1, equal amounts are dispensed. Both reservoirs 20 and 30 are still full enough. During the second dispensing cycle, sensor 32 detects that fill level 31 has been reached, and that no more than a residual volume 33 remains in reservoir 30. Sensor 32 transmits a corresponding signal $S_2$ to controller 8. Dispensing cycle D2 is continued until completion, with the targeted amounts $V_1$ and $V_2$ being dispensed in the process. Since sensor 22 has not detected that fill level 21 in reservoir 20 (sensor signal $S_1$ remains "0") has been reached, it is to be assumed that the volumes held in reservoirs 20 and 30 differ in terms of the ratio of their capacities. The controller processes this information such that a counter Z is incremented at the end of the dispensing cycle. This occurs always when, at the end of a dispensing cycle D, the signals of the two sensors 22 and 32 are detected to be different. This is the case at the end of the second dispensing cycle, so that counter Z is incremented from "0" to "1".

In addition, at the beginning of dispensing cycle D3, an adjustment is made to the amount $V_1$ of the first treating agent to be dispensed and/or to the amount $V_2$ of the second treating agent to be dispensed. In the exemplary embodiment shown, the first treating agent is dispensed in a larger amount $V_1$, i.e., two metered doses are dispensed. At the end of dispensing cycle D3, first sensor 22 has not yet detected that fill level 21 has been reached. Accordingly, counter Z is incremented to 2.

In fourth dispensing cycle D4, again, a larger amount $V_1$ of the first treating agent is added, whereas the second treating agent is added in a smaller amount $V_2$. In this cycle, first sensor 22 also detects fill level 21; sensor signal $S_1$ rises to "1". Thus, both sensors 22 and 32 signal the same condition, i.e. that the fill levels in reservoirs 20 and 30 are now both in the range of a residual volume 23 or 33, respectively. When the signals at sensors 22 and 32 are at the same state, counter Z is to be decremented by one. Accordingly, at the end of the fourth dispensing cycle, the counter is returned to 1.

In the fifth dispensing cycle, a double amount $V_1$ of the first treating agent is added once again because the counter is at "1". Since the signals at the two sensors are at the same state, counter Z is returned to 0 after the fifth dispensing cycle is completed. In sixth dispensing cycle D6, equal amounts $V_1$ and $V_2$ are dispensed again.

When residual volume 23 is reached in both reservoirs 20 and 30, an alert is issued, informing the user that both reservoirs 20 and 30 need to be filled. It is also possible to issue a refill alert only when a reservoir 20 or 30 is actually completely empty.

The adjustment of the amounts $V_1$ and $V_2$ of the first and second treating agents is preferably done only by an increase in an amount to be dispensed, and in such a way that the minimum required amount of a treating agent is always present in a wash cycle.

The control method illustrated in FIG. 4 can also be modified within the scope of the present invention. For example, instead of a switchable sensor 22 or 32, a different sensor could be used for fill-level monitoring. Moreover, it would be possible to provide two or more sensors on a reservoir 20, 30 to allow for finer adjustment of the amounts to be dispensed.

While the invention has been particularly shown and described with reference to preferred embodiments thereof, it will be understood by those skilled in the art that various changes in form and details may be made therein without departing from the spirit and scope of the invention.

What is claimed is:

1. A method for dispensing a first treating agent and a second treating agent into a washing tub of a dishwasher including a first reservoir and a first dispensing device corresponding to the first treating agent and a second reservoir and a second dispensing device corresponding to the second treating agent, the method comprising:

providing each of the first and second reservoir with at least one sensor for monitoring a fill level of the respective reservoir;

comparing, using a controller, after a first dispensing operation, first and second sensor signals corresponding to the at least one sensor of the respective first and second reservoirs;

determining, using the controller, based on the first and second sensor signals, whether a first ratio of a fill level of the first reservoir to a fill level of the second reservoir deviates from a second ratio of a capacity of the first reservoir to a capacity of the second reservoir; and electing, based on the determining, one of:

a standard subsequent dispensing operation if the first ratio does not deviate from the second ratio, and an alternative subsequent dispensing operation if the first ratio does deviate from the second ratio, wherein the standard subsequent dispensing operation includes controlling, with the controller, the first and second dispensing devices so as to dispense an amount from the first dispensing device and an amount from the second dispensing device, a third ratio of the amount from the first dispensing device to the amount from the second dispensing device being substantially equal to the second ratio, and wherein the alternative subsequent dispensing operation includes changing an amount dispensed by at least one of the first and second dispensing devices compared to a respective corresponding amount dispensed in the first dispensing operation.

2. The method as recited in claim 1 wherein, each of the first and second reservoir includes a single sensor for monitoring the fill level of the respective reservoir, and each sensor is operable to monitor a discrete fill level corresponding to a predetermined residual volume of the respective reservoir.

3. The method as recited in claim 2, wherein the predetermined residual volume of each reservoir is about 20% of the respective capacity of the respective reservoir.

4. The method as recited in claim 1, wherein, if the controller determines that the first ratio deviates from the second ratio, the controller ascertains which of the first and second reservoirs is an excess reservoir, the excess reservoir having a fill level greater than a level corresponding to the second ratio, and wherein the alternative subsequent dispensing operation includes reducing an amount dispensed from the excess reservoir by 20% to 50%.

5. The method as recited in claim 1, wherein, if the controller determines that the first ratio deviates from the second ratio, the controller ascertains which of the first and second reservoirs is a lesser reservoir, the lesser reservoir having a fill level smaller than a level corresponding to the second ratio, and wherein the alternative subsequent dispensing operation includes increasing an amount dispensed from the lesser reservoir by 20% to 50%.

6. The method as recited in claim 2, wherein the determining includes ascertaining which of the first and second reservoirs reaches the respective discrete fill level first, and wherein the alternative subsequent dispensing operation includes decreasing the amount dispensed from the reservoir which reaches the respective discrete fill level first by 20% to 50%.

7. The method as recited in claim 2, wherein the determining includes ascertaining which of the first and second reservoirs reaches the respective discrete fill level first, and wherein the alternative subsequent dispensing operation includes increasing the amount dispensed from the reservoir which does not reach the respective discrete fill level first by 20% to 50%.

8. The method as recited in claim 2, wherein, if the first ratio deviates from the second ratio and the controller determines that only one of the first and second reservoir has reached the discrete fill level, the controller performs additional alternative subsequent dispensing operations and counts a number of the alternative subsequent dispensing operations carried out until the sensors monitor that the respective discrete fill level has been reached in each of the first and second reservoirs.

9. The method as recited in claim 8, wherein once the discrete fill level has been reached in both the first and second reservoirs, the controller performs an additional number of alternative subsequent dispensing operations.

10. The method as recited in claim 1, further comprising issuing an alert when the first and second reservoirs substantially reach an empty level.

11. The method as recited in claim 1, further comprising issuing an alert shortly before the first and second reservoirs have reached an empty level.

* * * * *